United States Patent [19]

Montaner

[11] Patent Number: 5,064,102

[45] Date of Patent: Nov. 12, 1991

[54] NON-REUSABLE DISPENSING PUMP CONTAINER WITH REUSABLE DISPENSING PUMP

[75] Inventor: Pere P. Montaner, Esplugues De Llobregat, Spain

[73] Assignee: Monturas S.A., Barcelona, Spain

[21] Appl. No.: 492,772

[22] Filed: Mar. 13, 1990

[30] Foreign Application Priority Data

Mar. 29, 1989 [ES] Spain ..... 8901093

[51] Int. Cl.[5] ..... B67D 5/40

[52] U.S. Cl. ..... 222/147; 222/321; 222/385

[58] Field of Search ..... 222/147, 320, 321, 339–341, 222/372, 380, 382, 383, 385; 239/333

[56] References Cited

U.S. PATENT DOCUMENTS

| | | | |
|---|---|---|---|
| 3,120,328 | 2/1964 | Corsette et al. | 222/321 |
| 3,129,854 | 4/1964 | Boehm et al. | 222/321 |
| 3,770,206 | 11/1973 | Tada | 222/385 X |
| 3,991,914 | 11/1976 | Kotuby et al. | 222/385 X |
| 4,022,354 | 5/1977 | Kotuby | 222/321 |
| 4,154,369 | 5/1979 | Morane | 222/147 |
| 4,821,923 | 4/1989 | Skorka | 222/382 X |
| 4,949,878 | 8/1990 | Jacobi | 222/147 X |

FOREIGN PATENT DOCUMENTS

| | | | |
|---|---|---|---|
| 0065214 | 11/1982 | European Pat. Off. | 222/383 |

*Primary Examiner*—Kevin P. Shaver
*Attorney, Agent, or Firm*—Staas & Halsey

[57] ABSTRACT

A dispensing pump for a fluid in a container, in which the component parts form two units which are functionally joined together by a coupling member, while being easily separable. The component parts of each unit are non-separably assembled together. The second unit includes a valve for communication with the container and is inseparably attached to the container and is further provided with a device restraining access to the valve, whereby this second unit acts as a seal for the container. The first unit comprises a cylinder, piston, actuator spring and a communication passage with the external environment and can be attached to successive second units.

10 Claims, 3 Drawing Sheets

NON-REUSABLE DISPENSING PUMP CONTAINER WITH REUSABLE DISPENSING PUMP

BACKGROUND OF THE INVENTION

The invention relates to a dispensing pump for a fluid contained in a container, said pump having: a) a first group of members including: a cylinder defining a pumping chamber; a piston adapted to slide within said cylinder; actuator means for said piston; a resilient member engaging said piston; first communication means between the pumping chamber and the external environment; a first valve for regulating said communication with the external environment; and a member for coupling with the container; and b) a second group of members including second communication means between the pumping chamber and the container; and a second valve for regulating said second communication means.

Containers holding a fluid preferably for hygiene or cleaning purposes are being ever increasingly used particularly in the home. The container is regularly and desirably provided with a dispensing pump which facilitates the application and even the metering of the fluid to be used. There is contemplated also the possibility of the pump allowing for spraying and even foaming of the contained fluid. The pump is also frequently irreversibly connected to the container, ensuring the quantity and the quality of the contents.

SUMMARY OF THE INVENTION

The situation referred to above suffers from the drawback that it is necessary to acquire a complete pump with each container, bottle or the like, with said pump being useless for the user after the contents of the container have been used. The recovery or recycling of the pump by the manufacturer is not reasonably feasible either, which makes use more expensive.

To overcome the above drawbacks, the present invention provides a pump of the type mentioned above characterised fundamentally in that said first group and said second group respectively form first and second units the members of each of which are assembled together in a way making them in-separable, said second unit being adapted to be inseparably attached to the container, said first and second units being functionally connected together by a coupling member and downstream of said second valve there is a device restraining access to said second valve.

With the pump of the invention, the user first purchases a container with the complete pump. When the contents have been used, he removes the first unit and disposes of the container together with the second unit when replacing the product, be only needs to purchase a new container with a new second unit and mount the initial first unit to the new purchase, with obvious saving, since said first unit includes a major portion of the pump members which are furthermore, the most expensive ones.

With the second unit being inseparably allowed to the container, it obviously acts as a seal preventing tampering with the contents of the latter. The security of this arrangement is due in part to it being impossible to empty the container without the aid of the first unit and in part to refilling of the container being prevented due to the above-mentioned restriction of access to the second valve which regulates communication with the interior of the container.

BRIEF DESCRIPTION OF THE DRAWINGS

Further advantages and features of the invention will be appreciated from the following description, in which preferred embodiments of the invention are described without any limiting nature, with the reference to the accompanying drawings in which.

DETAILED DESCRIPTION OF THE INVENTION

Figure 1:
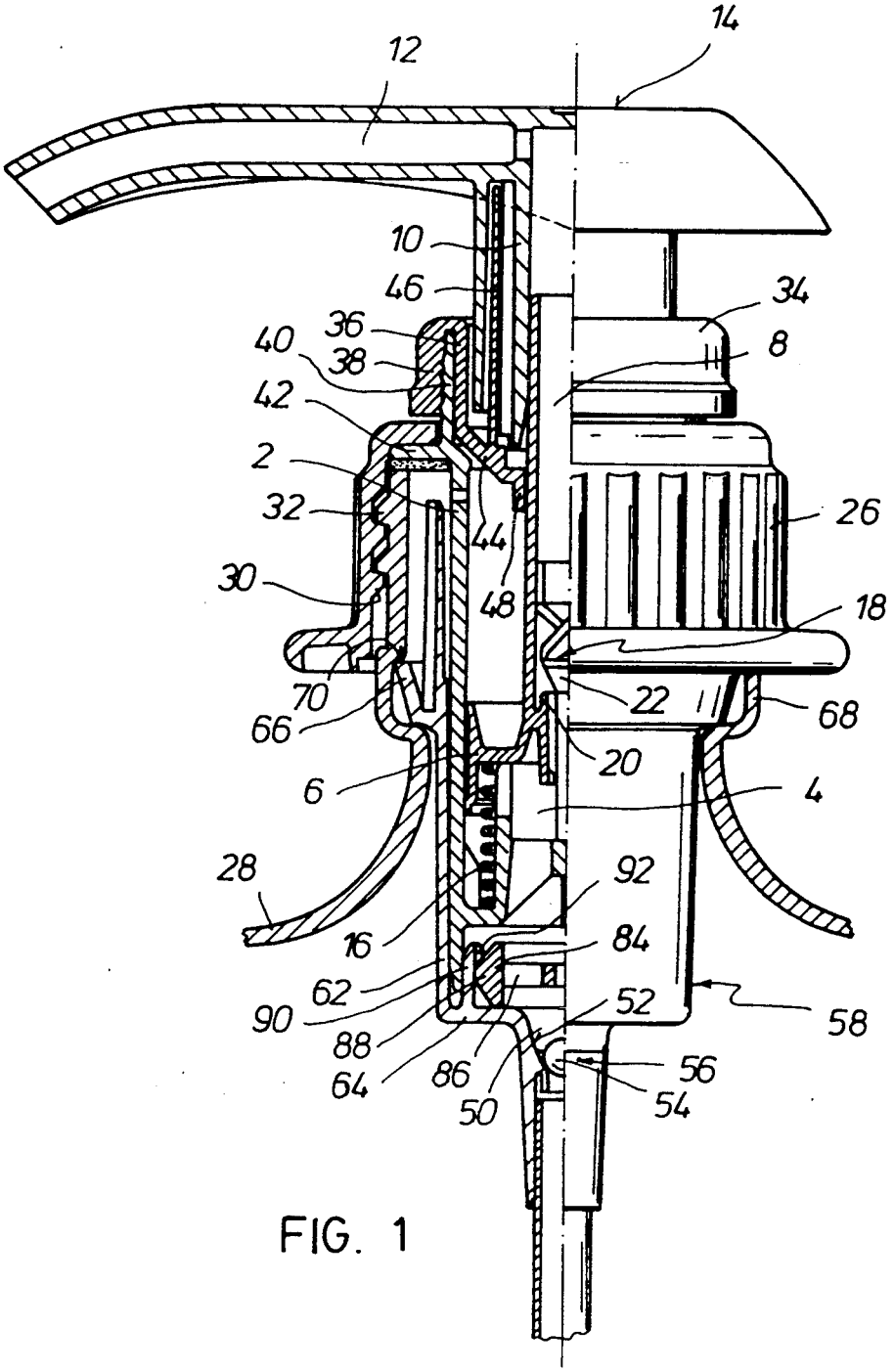
FIG. 1 is a side elevational view, partly in cross section on a diametral plane, of the dispensing pump according to the invention in the maximum compression state, part of the container being shown in section.

The dispensing pump of the invention is in many ways no different from a conventional pump. Therefore, it is provided with a first group of members to be referred to hereinafter. In the first place there is a cylinder 2 defining therein a pumping chamber 4 which is shown in FIG. 1 to be in its smallest capacity position. Associated with the cylinder 2 there is a piston 6 adapted to slide within the cylinder between a first position (FIG. 2) determining the maximum volume of the pumping chamber and a second position (FIG. 1) corresponding to the minimum volume of said chamber 4. It should be noted, however, that the cylinder of the invention has no bottom, to which further reference will be made hereinafter.

In the example shown, the piston 6 is extended by a hollow stem 8 associated with a tube 10 of a dispensing nozzle 12, in such a way that the piston 6 and stem 8 are attached to the tube 10 and nozzle 12 and may be moved thereby, whereby the upper surface 14 of the nozzle 12 represents an actuator means for the piston obviously a force applied to said surface causes the piston 6 to slide within the cylinder 2. A resilient member or spring 16 engages said piston 6 and urges it to the said first position.

The association of the hollow stem 8, tube 10 and nozzle 12 forms first communication means between the pumping chamber 4 and the external environment. This communication is regulated by a valve 18 formed by a valve seat 20 and a stopper 22. No further details of the type of valve shown are given, since the configuration and special operation thereof are not a part of the present invention. The valve 18 is urged to the closed position thereof by a spring 24 (FIG. 2) and opens in due time to allow the fluid contained in the pumping chamber 4 to be dispensed.

A coupling member 26 allows the pump to be connected to a container 28. In the example shown member 26 is generally hood-shaped and is provided With an internal thread 30 adapted to engage a thread 32 of the container neck. Further hereinafter another way of threading the member 26 will be disclosed. It should also be noted that the member 26 may be attached by other means, such as by a twist lock or any other appropriate means allowing an easily reversible connection to be made between the pump and the container 28.

The pump is also provided with assembly means allowing the first group of members described to form a first unit wherein the component members are substantially non-separately assembled together. In the example shown, there is a assembly member 34 which is outstanding for the assembly of said first unit.

The assembly member 34 is provided with a cylindrical portion 36 extended to the outside by a skirt portion 38, between which an upper crown 40 extending from the cylinder 2 is retained. The connection may be by way of threads or be a press fit between mating retaining grooves. The cylinder is also provided with a tab 42 and between said tab and the lower edge of the skirt 38 there is loosely contained a portion of the coupling member 26, whereby the assembly of said member 26 is ensured.

The cylindrical portion 36 of the assembly member 34 extends inwardly over a frustoconical portion 44, from which there emerges an upper tubular portion 46 serving as a guide for the nozzle tube 10 and a lower tubular portion 48 which guides the hollow stem 8 and limits the upstream movement of the piston 6. It is easy to imagine the steps required for assembling the first unit, so the description thereof is omitted.

Figure 2:
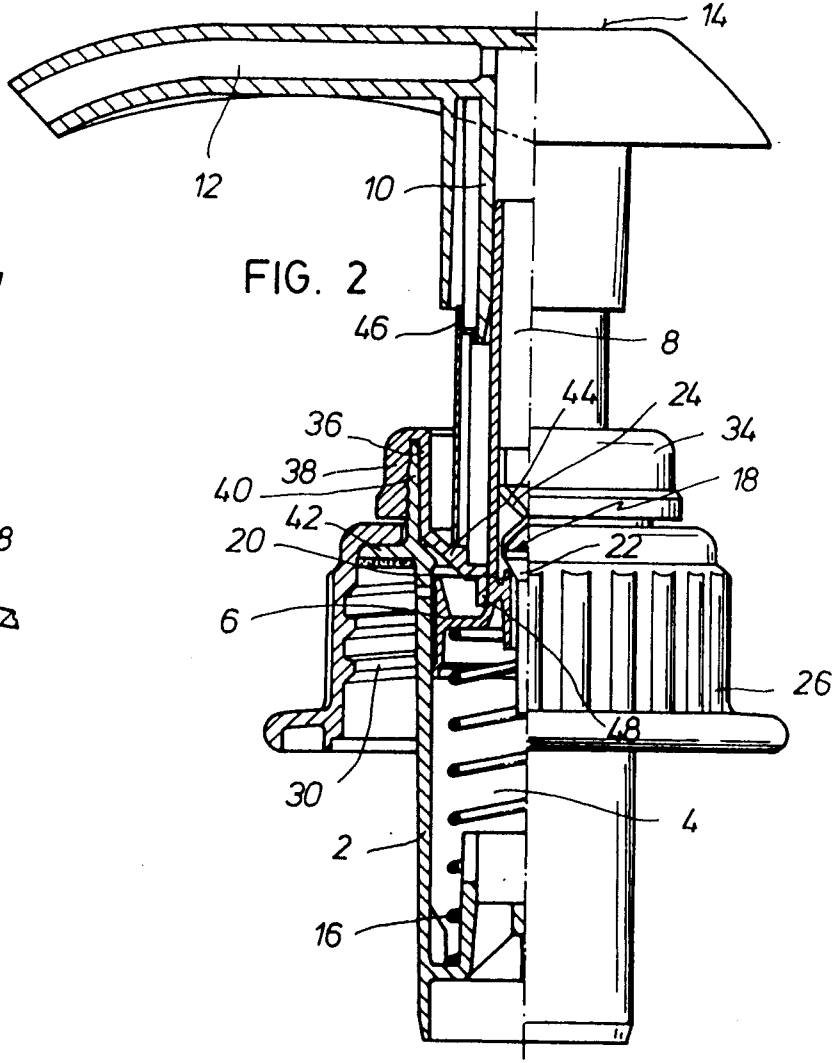
FIG. 2 is a similar view to that of FIG. 1 of the first pump unit.

It should be noted once again that a simple example of assembly has been described and that the invention includes other rational solutions appropriate for the intended purpose. The first unit is shown in FIG. 2.

The pump is provided also with a second group of members among which there is a passage 50 includes within a second communication means between the pumping chamber 4 and the interior of the container. Within this passage 50 there is a valve seat 52 and a stopper 54 forming therebetween a second valve regulating the communication between the chamber 4 and the container.

Preferably said second group also includes a cup-shaped member 58 provided with the passage 50 and which houses said second valve 56. The second group members are substantially non-separably assembled together.

Figure 3:
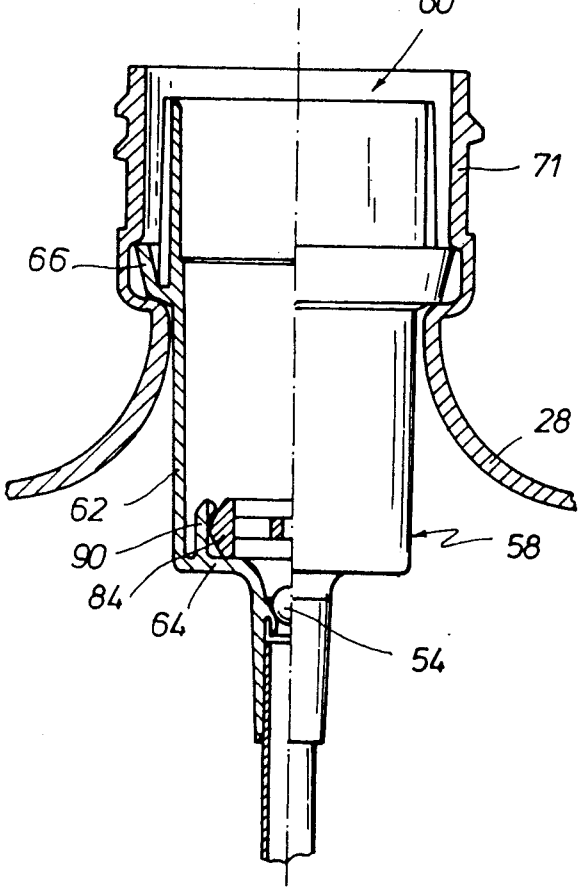
FIG. 3 is a similar view to the previous ones of the second pump unit, part of the container being shown in section.

The cup-shaped member 68 is provided with an open end 60 (FIG. 3) terminating in a rounded and preferably slightly conical side portion 62 tapering outwardly towards the open 60, within which there is fitted the cylinder 2. The fit between the cup-shaped member 58 and the cylinder 2 is sufficiently snug to insure due tightness, but allows the former to be easily separated from the latter.

The cup-shaped member 58 is provided with a bottom portion 64 in which, as said above, there is situated the passage 50 and said bottom 64 acts as a bottom for the cylinder 2 and, therefore, also as a bottom for the pumping chamber 4.

Figure 4:
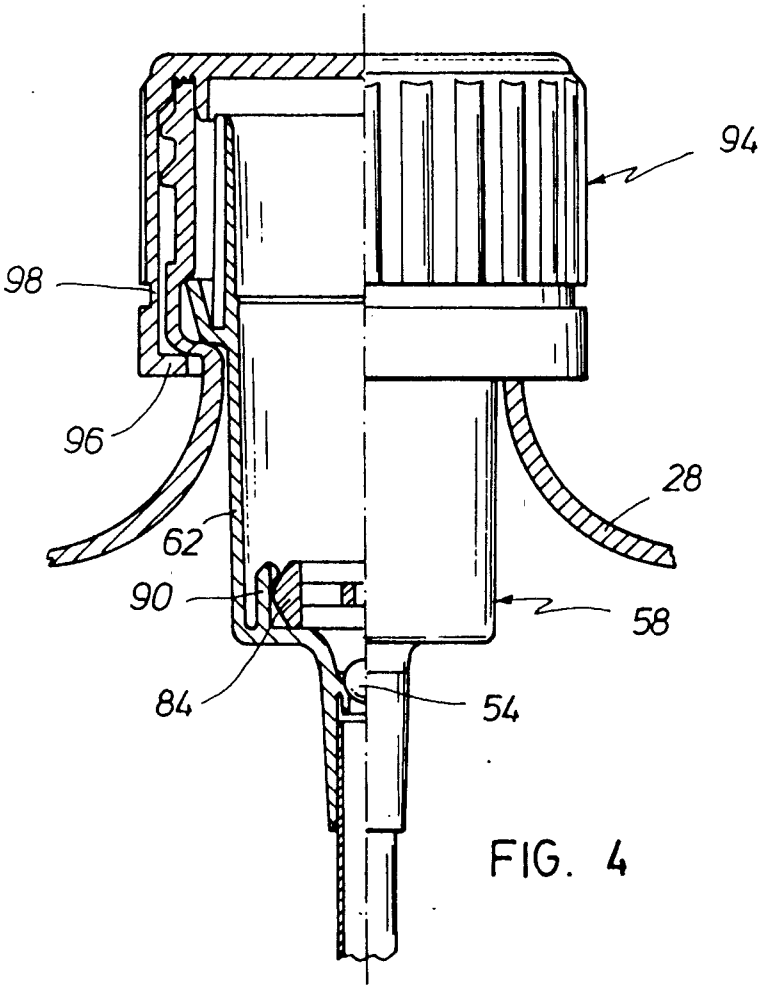
FIG. 4 is a similar view to the previous one, wherein said second unit is stoppered.

The second unit is adapted to be inseparably attached to the container, to which end the member 58 is provided with attachment means. In one embodiment (FIGS. 1, 3 and 4) said means includes a continuous resilient external flap 66 (or a plurality of separate flaps situated at the same level), which is divergently orientated relative to the side portion 62.

The flap 66 is provided to engage the container 28 which is provided with a widened portion 68, and upper edge 70 of which is orientated generally normal to the axis of the pump. The resilience of the flap allows the member 58 to slide downwardly along a neck 71 of the container and, on reaching the level of the widened portion, the flap 66 takes on the position shown. In this way the second unit is inseparably attached, whereby in practice the second unit may only be removed by destroying it.

Figure 5:
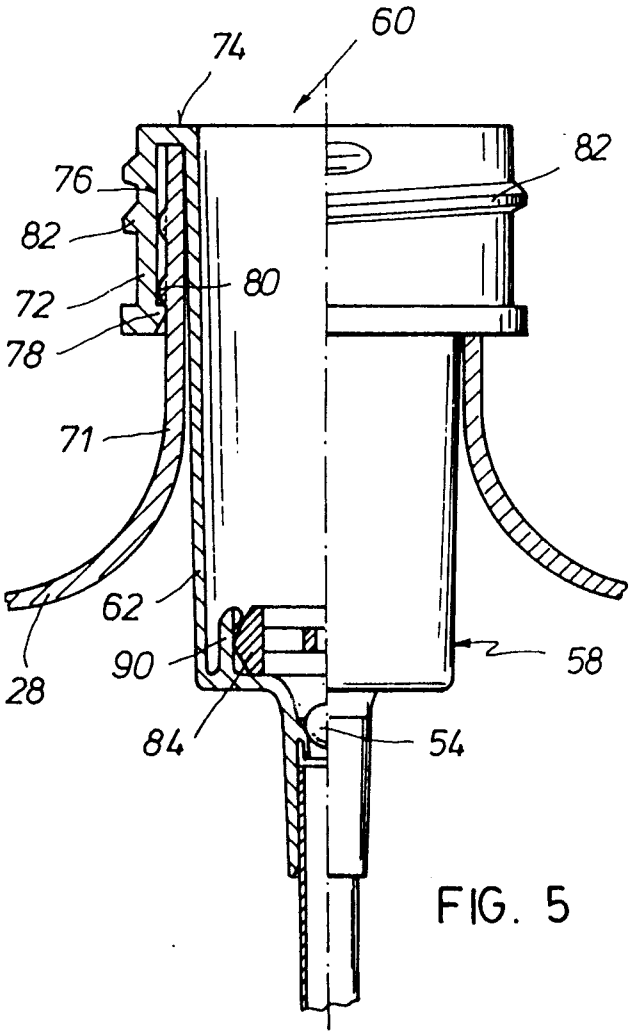
FIG. 5 is a similar view to that of FIG. 3, of a further embodiment of the second pump unit.

In a further embodiment (FIG. 5) there is a skirt member 72 extending from an edge 74 of the open end 60 of the cup-shaped member 72. Said skirt member extends generally coaxially to the side portion 62, leaving a space therebetween to contain a portion of the neck 71 of the container 28. On an inner surface 76 of the skirt member and, therefore, facing the side portion 62, there is at least one harpoon-shaped projection 78 which is adapted to be retained by a shoulder 80 of the neck 71. In this case also, the attachment of the second unit to the container 28 is sufficiently strong for its release to require, in practice, destruction of the second unit. In this embodiment the skirt member 72 is provided with a thread 82 capable of engaging the internal thread 30 of the coupling member 26.

It will be noted that the first and second units are firmly but separably functionally attached together, by way of the coupling member 26 which is threadedly attached either to the thread 32 of the neck or the thread 82 of the skirt member 72, after having inserted the cylinder 2 inside the cup-shaped member 58. It is clear that to separate the two units it is sufficient to unscrew the coupling member 26 or, if necessary, undo the reversible connection between the coupling member and the neck or skirt member.

A further important feature cf the pump described is that the container may not be refilled while the second unit is retained on the neck 71. To make the container non-refillable, there is contemplated a device restraining access to the second valve 56, so that it may not be tampered with.

One example of a restraining device is a disc 84 situated in the immediate proximity of the bottom 64 of the cup-shaped member 58. Said disc is provided with one or more small transverse passages 86 allowing the fluid to be dispensed to flow but preventing tampering with the stopper 54, whether this be a ball or a disc. Preferably the disc is provided with a side edge having a shoulder 88 which is set in a crown member 90 surrounding the passage 50, to which end the crown member is provided with an outwardly extending annular edge 92.

There is contemplated a sealing cap 94 (FIG. 4) having an inwardly directed retaining flange 96 and a weakened portion 98 which would be broken in an attempt to force it. On the one hand the sealing cap 94 prevents undesired spillage and on the other hand guarantees the integrity of the container and of the fluid contained therein.

The description of the pump operation is omitted because it belongs to the state of the art. Likewise no reference is made to known elements such as the dip tube communicating with the bottom of the container and other elements.

What I claim is:

1. A dispensing pump for a fluid contained in a container, comprising:

a) a first group of members including—
- a cylinder defining a pumping chamber,
- a piston adapted to slide within said cylinder,
- means for actuating said piston,
- a resilient member engaging said piston,
- first communication means between the pumping chamber and the external environment, a first valve for regulating said first communication means, and a member for coupling with the container, and b) a second group of members including— second communication means between the pumping chamber and the container, a cup-shaped member having an open end, a side portion and a bottom portion in which there is formed a passage forming part of said second communication means, and a second valve for regulating said second communication means, wherein said cylinder has a first open end insertable into said open end of said cup-shaped member and received by said side portion thereof, said first group and said second group respectively form first and second units, the members of each of which are practically inseparably assembled together, said second unit and container including retaining means for practically inseparably attaching the second unit to the container, said first and second units being separably connected together by said coupling member and downstream of said second valve there is a device restraining access to said second valve, said restraining device being associated with said bottom portion of said cup-shaped member.

2. The pump of claim 1, wherein said side portion tapers slightly towards the bottom.

3. The pump of claim 1, wherein said retaining means comprises at least one resilient external flap divergently disposed relative to the side portion.

4. The pump of claim 3, wherein said flap is annular and continuous.

5. The pump of claim 3, wherein said flap is adapted to be inserted in the container and be retained thereby.

6. The pump of claim 1, wherein said retaining means comprises a skirt member extending from said open end of said cup-shaped member generally coaxially on the outside of said side portion and the skirt member, on the surface thereof facing the side portion, is provided with at least one harpoon-shaped projection.

7. The pump of claim 6, wherein said projection is annular and continuous.

8. The pump of claim 6, wherein said skirt member, said side portion and said projection contain therebetween a neck of the container including a shoulder.

9. The pump of claim 1, wherein said restraining device comprises a disc situated in the immediate proximity of the bottom of the cup-shaped member and said disc is provided with at least one small transverse passage.

10. The pump of claim 9, wherein said bottom portion is provided with a crown member surrounding said passage and said disc is set in said crown member.

* * * * *